US007815550B2

(12) United States Patent
Watterson et al.

(10) Patent No.: US 7,815,550 B2
(45) Date of Patent: Oct. 19, 2010

(54) EXERCISE DEVICES, COMPONENTS FOR EXERCISE DEVICES AND RELATED METHODS

(75) Inventors: Eric S. Watterson, Logan, UT (US); Keith A. Taylor, Harrisville, UT (US); Gordon L. Cutler, Providence, UT (US)

(73) Assignee: Icon Health & Fitness, Inc., Logan, UT (US)

( * ) Notice: Subject to any disclaimer, the term of this patent is extended or adjusted under 35 U.S.C. 154(b) by 0 days.

(21) Appl. No.: 11/862,133

(22) Filed: Sep. 26, 2007

(65) Prior Publication Data

US 2009/0082176 A1 Mar. 26, 2009

(51) Int. Cl.
*A63B 22/02* (2006.01)

(52) U.S. Cl. ..... 482/54

(58) Field of Classification Search ..... 482/54, 482/51, 57, 69, 900, 904; 119/700
See application file for complete search history.

(56) References Cited

U.S. PATENT DOCUMENTS 2,746,822 A * 5/1956 Copenhaver ..... 248/188.5
4,350,336 A 9/1982 Hanford
4,664,371 A * 5/1987 Viander ..... 482/54
4,984,810 A * 1/1991 Stearns et al. ..... 482/54
5,072,928 A * 12/1991 Stearns et al. ..... 482/54
5,184,988 A * 2/1993 Dunham ..... 482/54
5,626,539 A * 5/1997 Piaget et al. ..... 482/54
5,649,882 A 7/1997 Parikh et al.
5,720,474 A * 2/1998 Sugiyama ..... 267/249
5,803,874 A * 9/1998 Wilkinson ..... 482/54
5,827,155 A 10/1998 Jensen et al.
5,989,161 A * 11/1999 Wang et al. ..... 482/54
6,347,603 B1 * 2/2002 Felger ..... 119/700
6,652,424 B2 11/2003 Dalebout
6,872,168 B2 * 3/2005 Wang et al. ..... 482/54
6,923,747 B1 * 8/2005 Chu ..... 482/54
6,953,418 B1 10/2005 Chen
7,022,051 B2 * 4/2006 Ota ..... 482/54

(Continued)

FOREIGN PATENT DOCUMENTS

GB 2139513 A * 11/1984

OTHER PUBLICATIONS http://dictionary.reference.com/browse/contiguous.*

(Continued)

*Primary Examiner*—Loan Thanh
*Assistant Examiner*—Daniel F Roland
(74) *Attorney, Agent, or Firm*—Holland & Hart, LLP

(57) ABSTRACT

Exercise devices, components for exercise devices and related methods are provided. In one embodiment, an exercise device is provided in the form of a treadmill including a frame, a platform or deck, a continuous or circuitous belt surrounding the platform, and at least one columnar member coupled with e frame and extending generally upwards from the frame when the exercise device is in an intended operating orientation. A cushioning device is directly coupled to the columnar member and in contact with an underlying support surface. In one embodiment, the cushioning device may include a first end member coupled with the columnar member, a second end member in contact with the supporting surface, and one or more compression members disposed between the first end member and the second end member.

15 Claims, 7 Drawing Sheets

U.S. PATENT DOCUMENTS

| | | | | |
|---|---|---|---|---|
| 7,169,087 | B2 * | 1/2007 | Ercanbrack et al. | 482/52 |
| 7,293,510 | B1 * | 11/2007 | Siao | 108/147.19 |
| 7,435,205 | B2 * | 10/2008 | Reyes et al. | 482/54 |
| 7,563,203 | B2 * | 7/2009 | Dalebout et al. | 482/54 |
| 2001/0024998 | A1 | 9/2001 | Novak et al. | |
| 2002/0077221 | A1 * | 6/2002 | Dalebout et al. | 482/57 |
| 2003/0073545 | A1 * | 4/2003 | Liu et al. | 482/54 |
| 2003/0134718 | A1 * | 7/2003 | Kim | 482/54 |
| 2003/0153434 | A1 * | 8/2003 | Dalebout et al. | 482/54 |
| 2003/0222419 | A1 * | 12/2003 | Geary | 280/21.1 |
| 2004/0063549 | A1 * | 4/2004 | Kuo | 482/54 |
| 2004/0162191 | A1 * | 8/2004 | Ercanbrack et al. | 482/52 |
| 2004/0242378 | A1 * | 12/2004 | Pan et al. | 482/54 |
| 2005/0227819 | A1 * | 10/2005 | Chen | 482/54 |
| 2006/0122038 | A1 * | 6/2006 | Chou Lin | 482/54 |
| 2006/0160665 | A1 * | 7/2006 | Tai | 482/54 |
| 2006/0205568 | A1 * | 9/2006 | Huang | 482/54 |
| 2006/0247109 | A1 * | 11/2006 | Powell | 482/148 |
| 2006/0287163 | A1 * | 12/2006 | Wang | 482/54 |
| 2007/0015634 | A1 * | 1/2007 | Ho et al. | 482/54 |
| 2007/0060451 | A1 * | 3/2007 | Lucas | 482/54 |
| 2007/0123394 | A1 * | 5/2007 | Ercanbrack et al. | 482/52 |
| 2007/0191197 | A1 * | 8/2007 | Vittone et al. | 482/121 |
| 2007/0219066 | A1 * | 9/2007 | Wang | 482/54 |
| 2007/0225127 | A1 * | 9/2007 | Pan et al. | 482/54 |
| 2007/0281831 | A1 * | 12/2007 | Wang | 482/54 |
| 2008/0004162 | A1 * | 1/2008 | Chen | 482/54 |
| 2008/0070756 | A1 * | 3/2008 | Chu | 482/54 |
| 2008/0132386 | A1 * | 6/2008 | Helie et al. | 482/54 |
| 2008/0176717 | A1 * | 7/2008 | Wang | 482/54 |
| 2008/0176718 | A1 * | 7/2008 | Wang | 482/54 |
| 2008/0280734 | A1 * | 11/2008 | Dickie et al. | 482/54 |
| 2008/0300115 | A1 * | 12/2008 | Erlandson | 482/54 |

OTHER PUBLICATIONS

International Search Report dated Dec. 5, 2008, for International Application No. PCT/US2008/077484 (3 pages).

* cited by examiner

FIG. 6
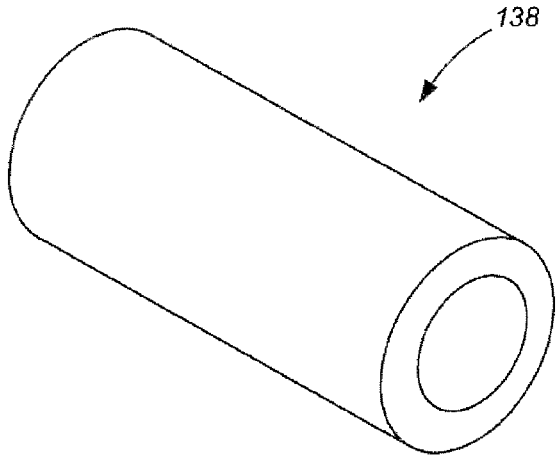
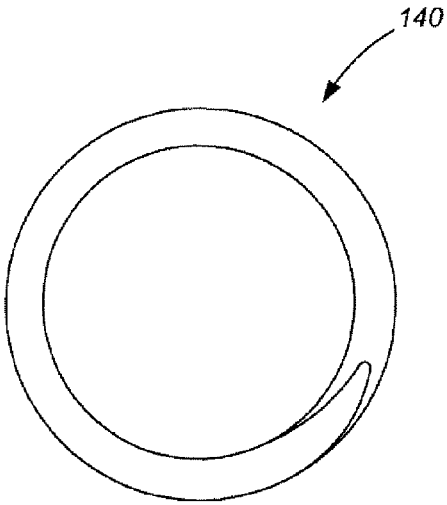
FIG. 7A
FIG. 7B
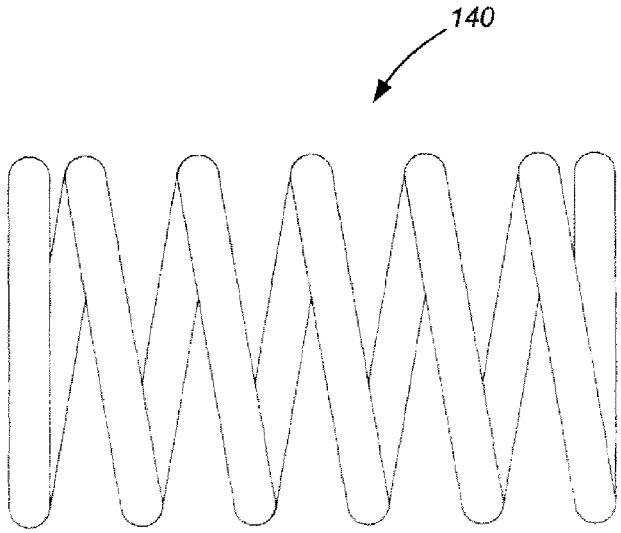

EXERCISE DEVICES, COMPONENTS FOR EXERCISE DEVICES AND RELATED METHODS

FIELD OF THE INVENTION

The present invention relates generally to exercise equipment and, more specifically, to exercise equipment including cushioning or shock-absorbing devices and related methods.

BACKGROUND OF THE INVENTION

There are numerous types of apparatuses and devices configured to help individuals exercise and maintain a desired level of health and fitness. Such apparatuses include, for example, treadmills, elliptical exercise machines, stationary bicycles, stair climbers (or steppers), and various types of strength training equipment. These types of exercise equipment, and others, are commonly found in health clubs, gyms and even in individuals' homes. One issue often considered in designing and manufacturing exercise equipment is providing the user with a challenging and effective workout in an ergonomic manner. It is also important to design exercise equipment that maintains structural stability while reducing, if not eliminating, the potential for injury to a user thereof.

One popular type of exercise equipment includes what is known as a treadmill. Treadmills conventionally include a continuous or circuitous belt positioned about one or more rollers and over a deck (sometimes also referred to as a platform or a base). One of the rollers is often driven to motivate the belt in a circuitous fashion while a user walks, jogs or runs on the belt, their feet typically landing on the belt at a location that is supported by the deck. The deck is conventionally rigid so as to support a user and withstand the pounding action imposed by an individual during use of the equipment. However, the rigid nature of the supporting deck can also impose a substantial impact on a user's body each time their foot lands on the belt and underlying deck. In some circumstances, such impact can lead to discomfort, pain and even injury to the user of the exercise equipment.

In short, certain types of exercise, whether such exercise is performed using an exercise device (such as with a treadmill) or without any substantial device or aid (such as jogging or running on asphalt or cement), particularly when the exercise involves a repetitive pounding or jarring motion, may eventually result in some type of pain or injury to the individual. Often, such pain or injuries are associated with the joints or tendons of the person exercising, but other types of pain or injury may also occur depending on specific circumstances.

In order to reduce the potential of such pain and injuries, various types of exercise equipment are constructed in an effort to reduce the amount of impact experienced by a user's body when they are using the equipment. Considering treadmills as an example, such are often designed and manufactured in an attempt to cushion or absorb impact that is imposed to the equipment by a user and, therefore, allow the user to experience less impact on their body during exercise.

Still considering treadmills as an example, various arrangements have been proposed to provide a resilient or cushioning effect for the treadmill user. One such design includes that which is described in U.S. Pat. No. 5,8271,155, issued to Jensen et al. (hereinafter the "Jensen" patent) and assigned to the assignee hereof, the disclosure of which is incorporated by reference herein in its entirety. The Jensen patent describes the use of various types of "cushioning" or "shock absorbing" arrangements including the use of adjustable spring structures coupled to what is sometimes referred to as the "free end" (i.e., the rearward end during intended use) of the deck. The spring members are described as being longitudinally adjustable so as to adjust the level of resiliency provided thereby.

Various other types of arrangements have also been proposed to provide a level or cushioning or shock absorbing in treadmills or other types of exercise equipment including coating e surface of the deck with a resilient or cushioned coating or by providing "deckless" treadmills wherein the continuous belt is supported in a substantially trampoline-like manner.

However, even with all of the proposed prior art solutions, it is an ongoing desire of the exercise industry to provide more effective and more efficient means of cushioning and absorbing shock or impact forces experienced by a user of exercise equipment. Thus, it would be desirable to provide a relatively simple, rugged and reliable structure for cushioning or absorbing impact forces imposed on a user of exercise equipment without adding significant cost, complexity or weight to the apparatus.

BRIEF SUMMARY OF THE INVENTION

The present invention includes exercise devices, components for exercise devices and methods for absorbing or cushioning the impact associated with such exercise devices. For example, in accordance with one embodiment of the present invention, an exercise device is provided. The exercise device includes a platform and a frame coupled with the platform, the frame being configured for placement over a supporting surface during intended use of the exercise device. One or more columnar members are coupled with the frame and extend upward from the frame when the exercise device is in an intended operating orientation. At least one impact absorbing device is directly coupled to a columnar member, wherein the impact absorbing device is positioned and oriented to be in direct contact with the supporting surface during use of the exercise device. In one particular embodiment, the impact absorbing device may include a first end member directly coupled a columnar member, a second end member configured to engage the supporting surface, and at least one compression member disposed between the first end member and the second end member.

In accordance with another embodiment of the present invention, an impact absorbing device is provided. The device includes a first end member configured to be directly coupled with a component of an exercise machine. A second end member is configured to engage a supporting surface on which the exercise device is placed. A flexible core member having a substantially annular body is disposed between the first end member and the second end member. A coil spring is disposed between the first end member and the second end member. A fastening structure is coupled with at least a portion of the first end member and at least a portion of the second end member. In one embodiment, the coil spring may be disposed substantially coaxially with, and circumferentially about, the flexible core member.

In accordance with yet another embodiment of the present invention, a method of cushioning an exercise device is provided. The method includes providing an exercise device having a platform, a frame and at least one columnar member coupled with the frame and extending generally upwards from the frame when the exercise is in an intended operating orientation. An impact absorbing device is disposed directly between the at least one columnar member and an underlying support surface. A force is applied to the platform and transferred from the platform, through the columnar member and to the impact absorbing device.

Other embodiments, features and aspects of the present invention will also become apparent to those of ordinary skill in the art upon reading of the specification and claims and reference to the attached drawings.

BRIEF DESCRIPTION OF THE SEVERAL VIEWS OF THE DRAWINGS

The foregoing and other advantages of the invention will become apparent upon reading the following detailed description and upon reference to the drawings in which:

FIG. 6 is a perspective view of a her component of a cushioning apparatus in accordance with an embodiment of the present invention; and FIGS. 7A and 7B are end and side views, respectively, of yet another component of a cushioning apparatus in accordance with an embodiment of the present invention.

DETAILED DESCRIPTION OF THE INVENTION

Figure 1:
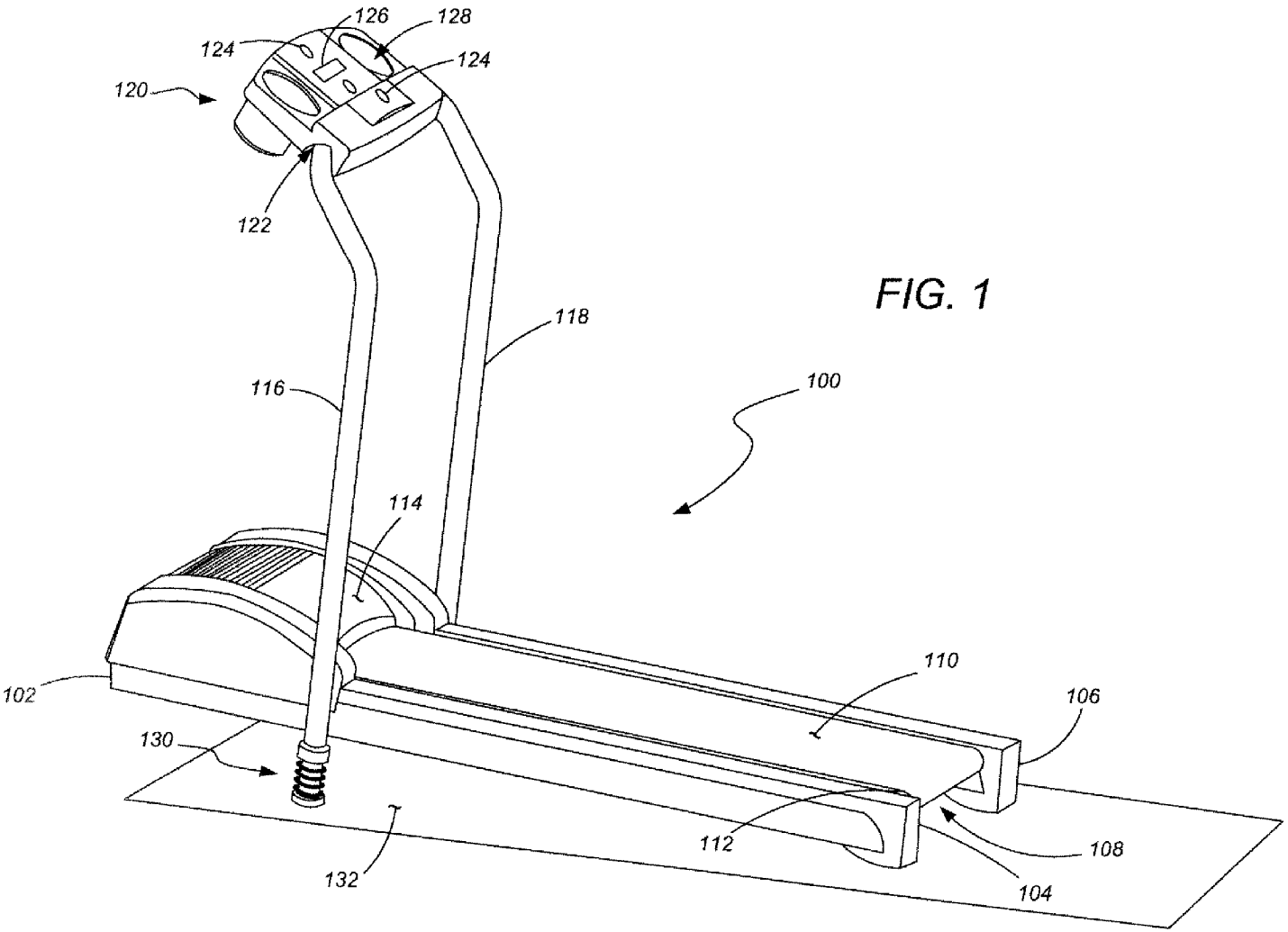
FIG. 1 is a perspective view of an exercise apparatus according to one embodiment of the present invention.

Referring to FIG. 1, an exercise apparatus in the form of a treadmill 100 is shown. The treadmill 100 includes a frame 102 including a first side member 104 and a second side member 106 spaced apart from the first side member 104. A platform or deck 108 is disposed between the first and second side members 104 and 106 and a continuous or circuitous belt 110 is disposed about the deck 108. The belt 110 may also be disposed about a first roller 112 extending between the side members 104 and 106 at one end of the frame 102 and a second roller (not specifically shown) extending between the side members 104 and 106 at an opposing end of the frame 102. A drive, which may include an AC or a DC motor, may be coupled to one of the rollers to drive the belt 110 about the rollers and the deck 108. In one embodiment, such a drive may be housed between the two side members 104 and 106 and, if desired, beneath a hood or faring 114 or other structure.

Columnar members 116 and 118, or other structural members, are coupled with the first side member 104 and second side member 106, respectively, and extend upwardly from the frame 102 to a console 120. The columnar members 116 and 118 may be coupled with the side members 104 and 106, respectively, by any of a variety of techniques including, for example, bolts, brackets, other mechanical fasteners, or by welding. The columnar members 114 and 116 may also be structurally coupled to each other such as by a cross member 122 or by way of the console 120. In one embodiment, the columnar members 116 and 118 and the cross member 122 may be formed as a substantially unitary member.

The console 120 may be coupled to the columnar members 116 and 118, the cross member 122, or to both. The console 120 may include various input and output devices. For example, one or more control buttons or function keys 124 may be used to control various aspects of operating the treadmill 100 such as on/off buttons or switches, speed control keys, incline control keys, keys for implementing workout programs or other input devices as will be appreciated by those of ordinary skill in the art. Additionally, the console 120 may include one or more displays 126 to provide a variety of information including, for example, information about the status of one or more operational characteristics of the treadmill 100 (e.g., speed, incline, programmed workout regimes, etc.) or information regarding a users workout (e.g., distance traveled, calories burned, etc.).

The console 120 may include other features as will be appreciated by those of ordinary skill in the art. For example, the console may include one or more structures 128 used for holding or storing various items while a user is utilizing the treadmill 100. In one embodiment, the structures 124 may be used for holding a drink, such as a water bottle, during a workout. Another component or feature that may be included with the console 120 is an emergency stop mechanism. For example, a switch (which may include magnetic, mechanical, electromechanical components or the like) may associated with a lanyard or other device tethered between the switch and the user such that if a user falls or is otherwise displaced relative to the console 120 beyond a specified distance, the switch or other mechanism will be actuated to shut down the treadmill 100 in an effort to prevent inadvertent injury to the user.

An impact absorbing or cushioning device 130 is located at the lower portion of each columnar member 116 and 118. In contrast to conventional cushioning devices associated with treadmills and other types of exercise equipment, the cushioning device is located and configured such that it is positioned directly between a portion of the associated columnar member 114 and 116 and a supporting surface 132 on which the treadmill 100 is located. The cushioning devices 130 help to dampen the impact forces felt by users when they are walking, jogging or running on the treadmill 100. For example, as a user is running, their feet impact the belt 110 and underlying deck 108. Without a cushioning device, the impact from such running would jar the user's body including, particularly, the joints in their lower body such as the knees, ankles, hips as well as the back.

Figure 2:
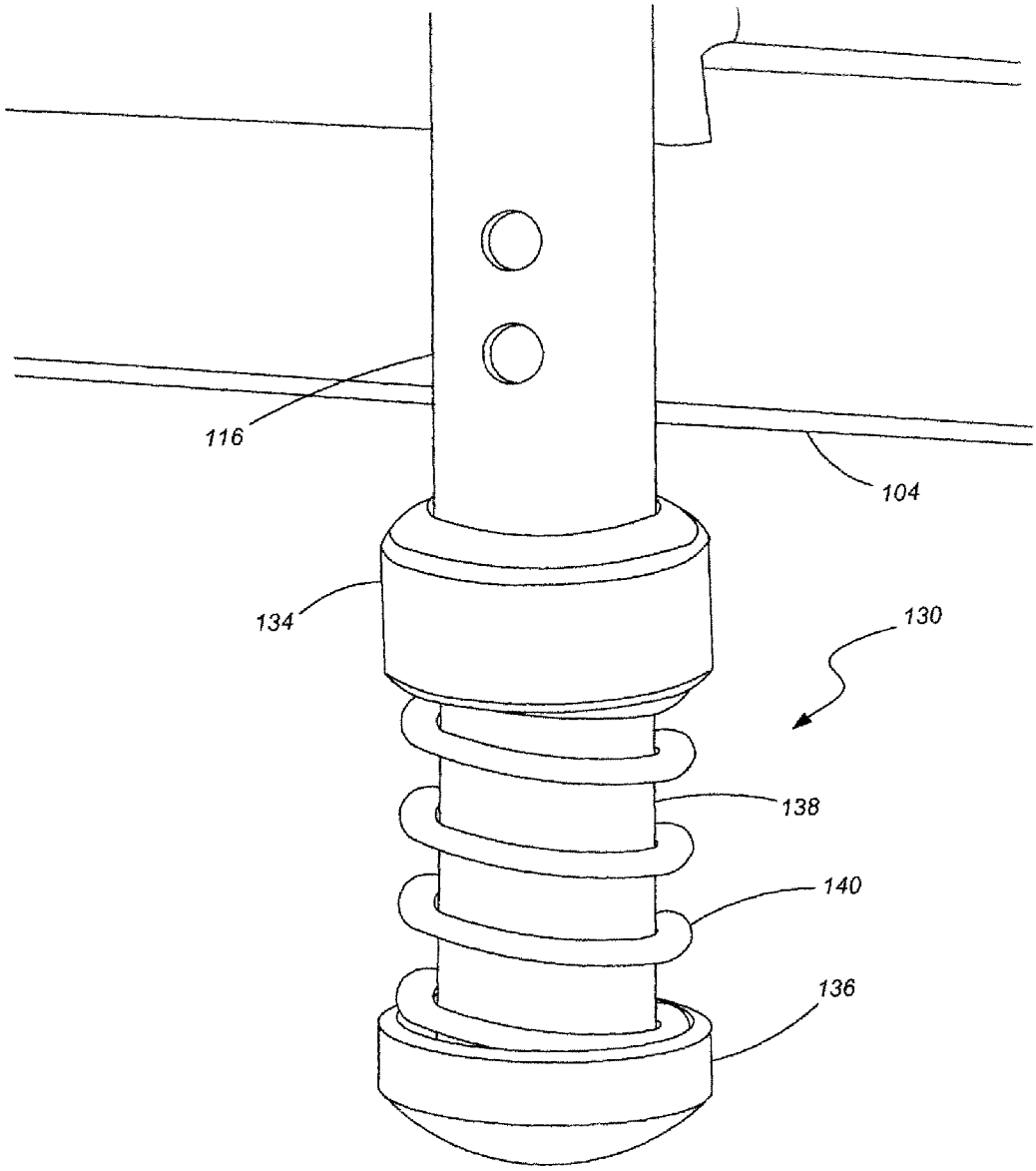
FIG. 2 is an enlarged detail view of a portion of the apparatus shown in FIG. 1.

Referring now to FIG. 2, an enlarged view is show of the cushioning device 130 coupled to the lower end of a columnar member 116. In the embodiment shown in FIG. 2, the cushioning device 130 includes a first component, which may be referred to herein as a cap or a first end member 134, coupled with the columnar member 116. Another component, which may be referred to as a foot or a second end member 136, is spaced from the first end member 134 and is positioned to rest on a supporting surface (e.g., on the floor or an exercise mat overlying the floor). A first compression member 138, which may also be referred to as a flexible core member, may be positioned between the first end member 134 and the second end member 136. Additionally, a second compression member 140, such as a coil spring, may be disposed about the first compression member 138 and between the first and second end members 134 and 136. It is noted that, in another embodiment, the second compression member 140 may be disposed internally of the first compression member 138. In yet another embodiment, one coil spring may be disposed circumferentially about the first compression member 138 while another coil spring may be disposed within an interior of the first compression member 138.

Figure 3A:
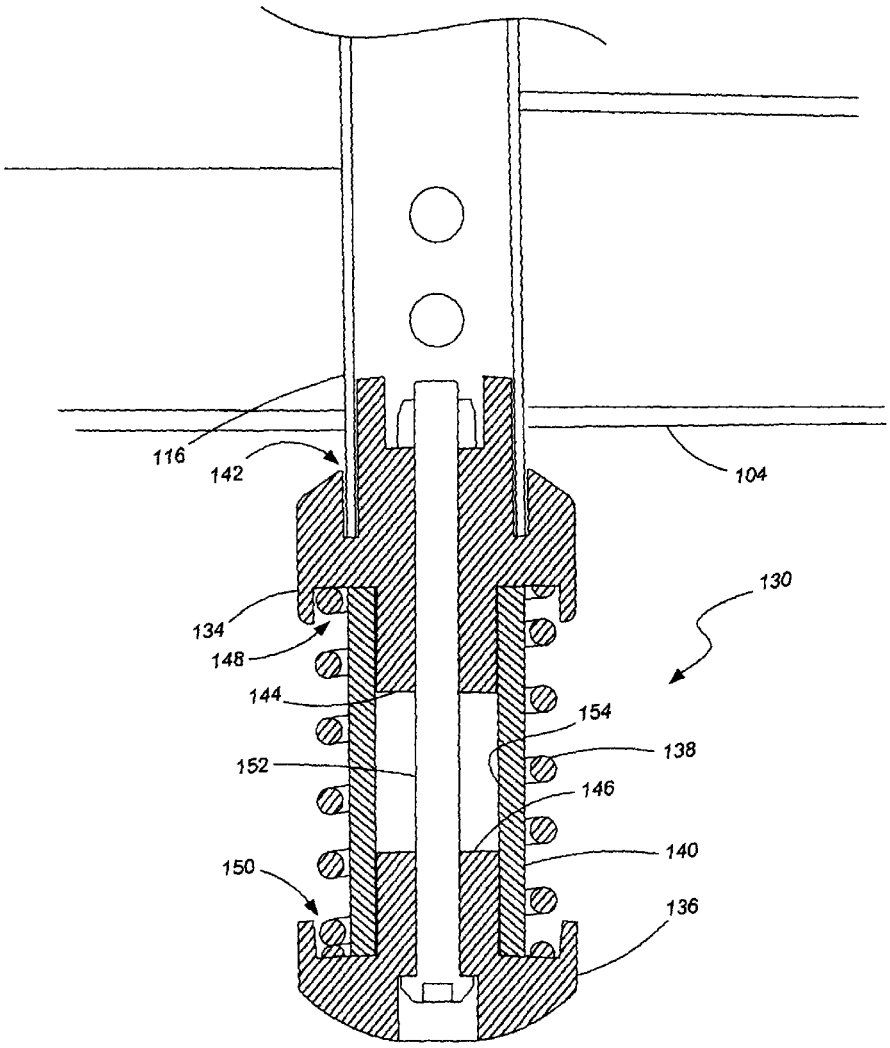
FIG. 3A is a partial cross-sectional view of the enlarged detailed portion shown in FIG. 2 while in a first position or state.
Figure 3B:
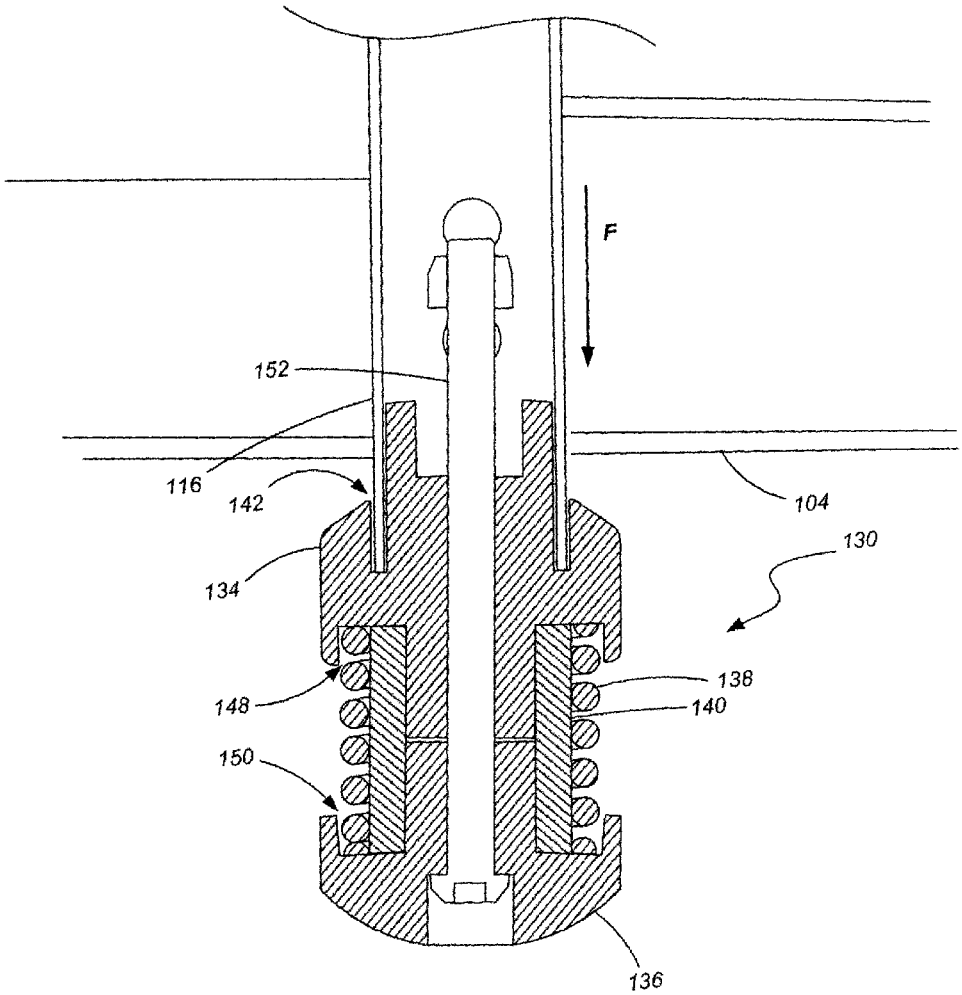
FIG. 3B is a partial cross-sectional view of the enlarged detailed portion shown in FIG. 2 while in a second position or state.
Figures 4A, 4B, 4C:
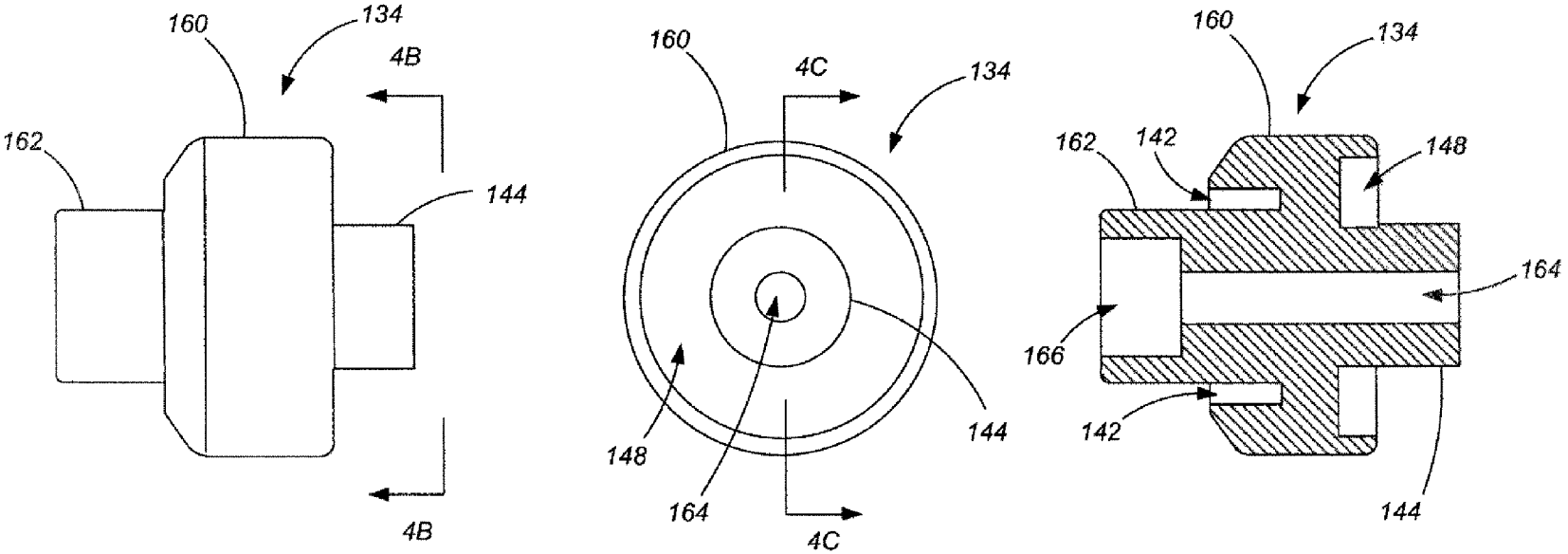
FIGS. 4A-4C are side, end and sectional views, respectively, of a component of a cushioning apparatus in accordance with an embodiment of the present invention.

As shown in FIGS. 3A and 3B, the first end member 134 may include a substantially annular groove 142 for receipt of a portion of the columnar member 116. In one embodiment, the grove 142 and columnar member may be cooperatively sized and configured such that a slight interference fit is effected between the two components. In another embodiment, the first end member 134 may be coupled to the columnar member 116, for example, by way of an appropriate fastener or through use of an adhesive material. In yet another embodiment, the coupling of the two components may be maintained simply by virtue of gravity with the columnar member 116 resting within the groove 142 of the first end member 134.

FIGS. 3A and 3B also show further details regarding the relationship of the first and second compression members 138 and 140 relative to the first and second end members 134 and 136 in accordance with one embodiment of the present invention. For example, the first and second end members 134 and 136 each include a protruding portion 144 and 146, respectively, that is sized and configured to be disposed within an interior portion of the first compression member 138. Further, the first and second end members 134 and 136 each include a groove 148 and 150, respectively, that cooperatively receives respective ends of the first compression member 138 and the second compression member 140.

As also seen in FIGS. 3A and 3B, the various components of the cushioning device 130 may be maintained relative to one another by using an appropriate fastening structure 152 such as a nut and bolt assembly. In one embodiment, the fastening structure 152 may extend through openings formed in the first and second end members 134 and 136 and through a region defined by an interior surface 154 of the first compression member 138. The fastening structure 144 may not only help keep the various components assembled (during manufacturing and assembly of, as well as use of, the treadmill 100), but it may also be sized to provide a desired amount of structural support to the cushioning device to avoid, for example, buckling of first compression member 138 or an undesired magnitude of lateral displacement of the first or second end members 134 and 136 relative to each other.

As seen by comparing FIG. 3A with 3B, when an external force "F" is applied to the columnar member 116, such as when a downward force is applied to the support deck 108 (FIG. 1) dung use of the treadmill 100 (which force may be transmitted from the deck 108 to the columnar members 116 and 118 via the side rails 104 and 106), the cushioning device 130 allows the columnar members 116 and associated side rail 104 to be displaced a desired distance relative to an underlying supporting surface while also providing a damping effect. This is accomplished through compression of the first and second compression members 138 and 140 as is indicated in FIG. 3B. Additionally, in some embodiments, the first end member 134, the second end member 136, or both, may exhibit some compressive deformation depending, for example, on the materials from which they are formed.

When the force F is removed from the treadmill 100, the cushioning device 130 will return to its previous state as shown in FIG. 3A based on the elastic deformation of the compression members 138 and 140. It is noted that the cushioning device 130 may be subject to varying magnitudes of forces such that it is displaced less than that shown in FIG. 3B. Additionally, in some configurations, the cushioning device 130 may be configured so that upon application of an external force F of a specified magnitude, the first and second end members 134 and 136 will experience enough displacement to cause their respective protruding portions 144 and 146 to contact one another. In one embodiment, the mutual contact of the two end members 134 and 136 may act to limit any additional displacement. In another embodiment, upon mutual contact of the end members 134 and 136, they will exhibit a certain amount of deformation to provide further resistance and damping such that an increased force is required to effect further significant displacement of the deck 108 (and frame 102 and columnar members 116, 118) relative to the underlying surface 132 (FIG. 1).

Referring to FIGS. 4A-4C, 5A-5C, 6, 7A and 7B, various views are shown of components that may be used in conjunction with the cushioning device according to one embodiment of the present invention. With respect to FIGS. 4A-4C, a side view, end view and cross-sectional view, respectively, are shown of the first end member 134 in accordance with one embodiment of the present invention. The first end member 134 includes a main body portion 160, a first projection or protruding portion 144 extending from the body portion 160 in a first direction and a second projection or protruding portion 162 extending from the body portion 160 in a second direction. A groove 148 is formed adjacent the first protruding portion 144 and another groove 142 is formed adjacent the second protruding portion 162. An opening 164 is formed through the first end member 134 that extends from the first protruding portion 144 to the second protruding portion 162. Part of the opening 164 includes a counterbore 166 formed in the second protruding portion 162.

In accordance with one embodiment of the invention, example dimensions that may used in forming the first end member 134 include the following: the overall length of the end member 134 (from an end surface of the first protruding portion 144 to an end surface of the second protruding portion 162) may be approximately 2.25 inches (2.25"); the main body portion 160 may exhibit an outer diameter of 2.00"; the first protruding portion 144 may exhibit an outer diameter of approximately 0.88" and may extend from the main body portion 160 a distance of approximately 0.50"; the second protruding portion 162 may exhibit an outer diameter of approximately 1.10" and may extend from the main body portion 160 a distance of approximately 0.67"; the groove 148 formed adjacent the first protruding portion 144 may be approximately 0.25" deep and exhibit an outer radius of approximately 1.78"; the groove 142 adjacent the second protruding portion 162 may be approximately 0.45" deep and exhibit an outer radius of approximately 1.36"; the opening 164 may exhibit a diameter of approximately 0.313" as it passes through the first protruding portion 144 while the counterbore 166 may exhibit a diameter of approximately 0.75" and a depth of approximately 0.50".

In one embodiment, the first end member 134 may be formed of a polyvinylchloride (PVC) material using an appropriate machining process. In other embodiments, the first end member 134 may be formed of other materials and/or may be formed using other processes including, for example, injection molding.

Figure 5C:
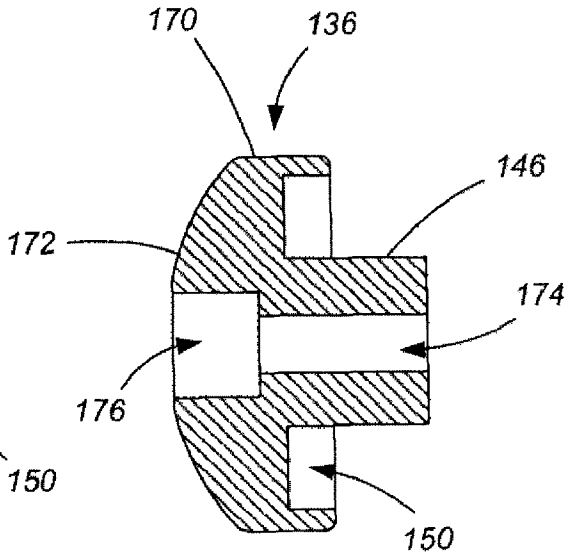
FIGS. 5A-5C are side, end and sectional views, respectively, of another component of a cushioning apparatus in accordance with an embodiment of the present invention.
Figure 5B:
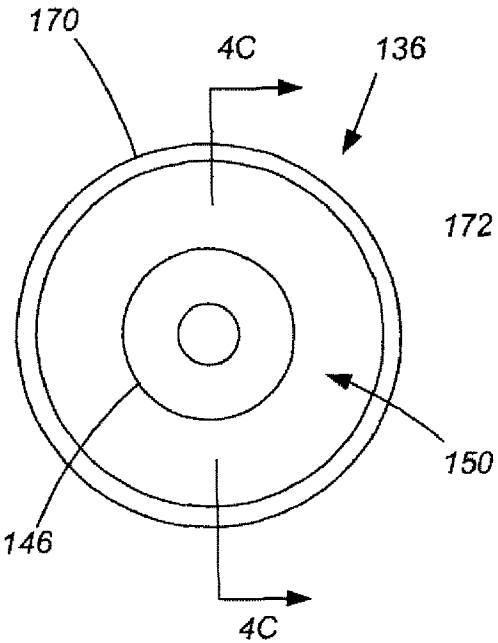
Figure 5A:
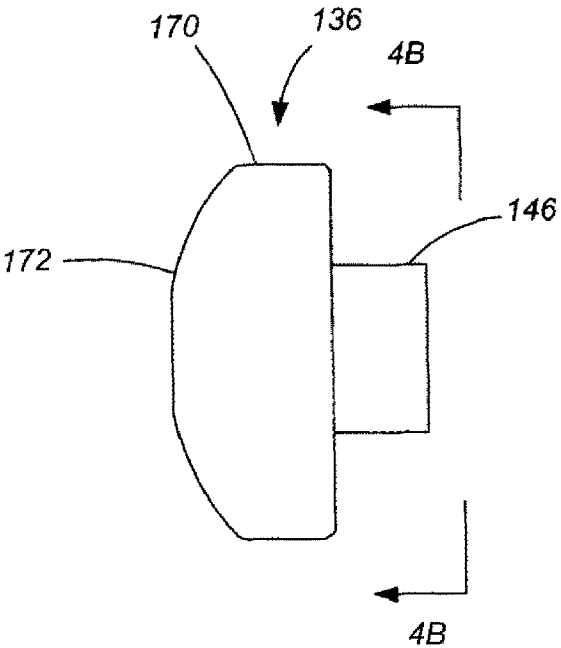

Referring now to FIGS. 5A-5C a side view, end view and cross-sectional view, respectively, are shown of the second end member 136 in accordance with one embodiment of the present invention. The second end member 136 includes a main body portion 170 having a contoured end surface 172. A projection or protruding portion 146 extending from the body portion 170 on a side generally opposite of the contoured end surface 172. A groove 150 is formed adjacent the protruding portion 146 as has been previously described. An opening 174 is formed through the second end member 134 that extends from the protruding portion 144 to the contoured end surface 172. Part of the opening 174 includes a counterbore 176 formed in the contoured end surface 172.

In accordance with one embodiment of the invention, example dimensions that may used in forming the second end member 136 include the following: the overall length of the second end member 136 (from an end surface of the protruding portion 146 to the outer most end of the contoured end surface 172) may be approximately 1.35"; the main body portion 160 may exhibit an outer diameter of approximately 2.00"; the protruding portion 146 may exhibit an outer diameter of approximately 0.88" and extend from the main body portion 160 a distance of approximately 0.50"; the groove 150 formed adjacent the protruding portion 146 may be approximately 0.25" deep and exhibit an outer radius of approximately 1.78"; the opening 174 may exhibit a diameter of approximately 0.313" as it passes through the protruding portion 146 while the counterbore 166 may exhibit a diameter of approximately 0.55" and a depth of approximately 0.45".

In one embodiment, the second end member 136 may be formed of a polyvinylchloride (PVC) material using an appropriate machining process. In other embodiments, the second end member 134 may be formed of other materials and/or may be formed using other processes including, for example, injection molding.

Referring briefly to FIG. 6, an example of a first compression member 138 is shown. The first compression member 138 may be formed as a substantially tubular or annular body. In one particular embodiment, the first compression member may exhibit a length of approximately 2.63", an internal diameter of approximately 0.88" and an outer diameter of approximately 0.92". The first compression member 138 may be formed of, for example, a flexible PVC material and exhibit a Shore A hardness of 45.

Referring now to FIGS. 7A and 7B, an example of a second compression member 140 is shown. The second compression member may include a coiled spring formed of spring steel having a diameter of approximately 0.188". The overall length of the compression member 140 may be approximately 2.63" with the coils exhibiting an inner diameter of approximately 1.35" and an outer diameter of approximately 1.73". The second compression member 140 may be configured to include 4.38 active coils and exhibit a spring rate of approximately 118 pounds per inch (lbs/in). In another embodiment, rather than exhibiting a substantially linear spring rate, the second compression member 138 may be formed to exhibit a "rising rate" wherein the amount of resistance of force exerted by the spring increases nonlinearly as it is compressed.

Of course, such dimensions set forth hereinabove are merely examples and may vary depending, for example, on the size of other related components and the type of material used to form the various components. As such, the example dimensions given herein are not to be considered limiting in any sense.

While the invention may be susceptible to various modifications and alternative forms, specific embodiments have been shown by way of example in the drawings and have been described in detail herein. However, it should be understood that the invention is not intended to be limited to the particular forms disclosed. For example, additional cushioning devices may be used and coupled to other components of the exercise device, or different types of cushioning devices may be disposed between the columnar members and the underlying surfaces. Thus, the invention includes all modifications, equivalents, and alternatives falling within the spirit and scope of the invention as defined by the following appended claims.

What is claimed is:

1. An exercise device comprising:

a platform; a circuitous belt disposed about the platform;

a frame coupled with the platform and configured for placement over a supporting surface during intended use;

at least one columnar member coupled with the frame and extending upward from the frame when the exercise device is in an intended operating orientation;

a console coupled with the at least one columnar member;

at least one impact absorbing device configured to absorb an impact force applied by a user while exercising on the exercise device, the at least one impact absorbing device being positioned between the supporting surface and an interconnection of the at least one columnar member and the frame, wherein the at least one impact absorbing device comprises:

a first end member directly coupled with the at least one columnar member;

a second end member configured to directly engage the supporting surface; and at least one compression member disposed between and in contact with each of the first end member and the second end member;

wherein, upon application of the impact force, the first end member is displaced toward the second end member.

2. The exercise device of claim 1, further comprising at least one roller coupled to the frame and wherein the circuitous belt is disposed about the at least one roller and the platform.

3. The exercise device of claim 1, wherein the at least one columnar member includes a first columnar member and a second columnar member, and wherein the at least one impact absorbing device includes a first impact absorbing device directly coupled with the first columnar member and a second impact absorbing device directly coupled with the second columnar member.

4. The exercise device of claim 1, wherein the at least one compression member is configured as a substantially annular body.

5. The exercise device of claim 1, wherein the at least one compression member includes a coil spring.

6. The exercise device of claim 1, wherein the at least one compression member includes a first compression member configured as a substantially annular body and a coil spring substantially coaxially disposed about the first compression member.

7. The exercise device of claim 6, wherein the first end member and the second end member are each formed of a material comprising polyvinylchloride (PVC) and wherein the first compression member is formed of a material comprising flexible PVC exhibiting a hardness of approximately 45 on a Shore A hardness scale.

8. The exercise device of claim 7, wherein the coil spring exhibits a spring constant of approximately 118 pounds per inch.

9. The exercise device of claim 1, wherein the first end member includes a main body portion, a first protruding portion extending from a first side of the main body portion, a second protruding portion extending from a second, opposing side of the main body portion, a first groove adjacent the first protruding portion sized and configured to receive a portion of the at least one columnar member, and a second groove adjacent the second protruding portion sized and configured to receive a portion of the at least one compression member.

10. The exercise device of claim 9, wherein the first protruding portion and the first groove are sized and configured to provide an interference fit with an end of the at least one columnar member.

11. The exercise device of claim 1, wherein the second member includes a main body portion having a contoured end surface, a protruding portion extending from the main body portion generally opposite the contoured end surface, and a groove formed adjacent the protruding portion sized and configured to receive another portion of the at least one compression member.

12. The exercise device of claim 11, further comprising at least one fastening structure coupled with at least the first end and second end members of the at least one impact absorbing device.

13. The exercise device of claim 12, wherein the first end member includes an opening extending therethrough, wherein the second member includes an opening extending therethrough, and wherein at least a part of the fastening structure extends through the opening of the first end member and through the opening of the second end member.

14. The exercise device of claim 13, wherein the fastening structure includes a nut and a bolt.

15. The exercise device of claim 1, wherein the at least one impact absorbing device is configured such that the first end member is displaced towards the second end member upon application of a force of a specified magnitude via the at least one columnar member.

* * * * *